United States Patent [19]

Liu et al.

[11] Patent Number: 4,896,927

[45] Date of Patent: Jan. 30, 1990

[54] COMBINATION CLIP-BOARD AND CASE

[76] Inventors: David Liu; Jane Keo, both of No. 95, Kung Cheng Rd., West District, Taichung, Taiwan

[21] Appl. No.: 317,432

[22] Filed: Mar. 1, 1989

[51] Int. Cl.[4] ..... A47B 63/00

[52] U.S. Cl. ..... 312/190; 24/67.11; 281/42; 281/45

[58] Field of Search ..... 312/183, 191, 192, 323, 312/190, 282; 281/42, 45; 24/67.11, 67 R, 67.7

[56] References Cited

U.S. PATENT DOCUMENTS

| | | | |
|---|---|---|---|
| 491,011 | 1/1893 | Dom | 24/67.7 |
| 2,606,774 | 8/1952 | Zalkind | 312/190 |
| 3,105,279 | 10/1963 | Westhoff | 24/67.7 X |
| 3,828,402 | 8/1974 | Gorman | 24/67.7 X |
| 4,565,413 | 1/1986 | Wallace | 312/323 X |
| 4,628,572 | 12/1986 | Chang | 281/45 |
| 4,745,662 | 5/1988 | Chang | 24/67.7 |

FOREIGN PATENT DOCUMENTS

| | | | |
|---|---|---|---|
| 16652 | 3/1916 | United Kingdom | 24/67.7 |

*Primary Examiner*—Joseph Falk
*Attorney, Agent, or Firm*—Bernard R. Gans

[57] ABSTRACT

A combination clip-board and case which is adapted to protect the paper when not in use, including a clip-board on which a clip is located integral with a pivoting member having a pin at each end thereof, and a case having a sliding groove and a hollow portion on each side of the case so that the pins are rotatable in the hollow portions. The clip-board is optionally settable to working or storage state due to the pins being rotatable in the hollow portions.

3 Claims, 8 Drawing Sheets

COMBINATION CLIP-BOARD AND CASE

BACKGROUND OF THE INVENTION

The present invention relates to a combination clip-board and case, more particularly to such a combination in which the clip-board is pivotable in the case and is slidable in a sliding groove of the case in such a manner that the clip-board can be optionally set in working or storage state.

Heretofore, clip-boards have been developed which are substantially boards 1 with clips 3, as shown in the exemplary case of FIG. 10. Such clip-boards can not clamp enough paper. Also, the clamped paper is exposed so as to be easily damaged and cannot be kept clean and flat.

SUMMARY OF THE INVENTION

In order to mitigate and/or obviate the above-mentioned drawbacks in the manner set forth in the detailed description of the preferred embodiment, the primary objective of the present invention is to provide a combination clip-board and case which enables the paper to be protected in the case and free from being damaged.

The other objective of the present invention is to provide a combination clip-board and case which can clamp more paper than a conventional clip-board.

Further objectives and advantages of the present invention will become apparent as the following description proceeds, and the features of novelty which characterize the invention will be pointed out with particularity in the claims annexed to and forming a part of this invention.

BRIEF DESCRIPTION OF THE DRAWINGS

Other important objectives, and functional and structural features of the invention will be apparent from the following detailed description taken with the accompanying drawings wherein.

DETAILED DESCRIPTION OF THE PREFERRED EMBODIMENT

Figure 2:
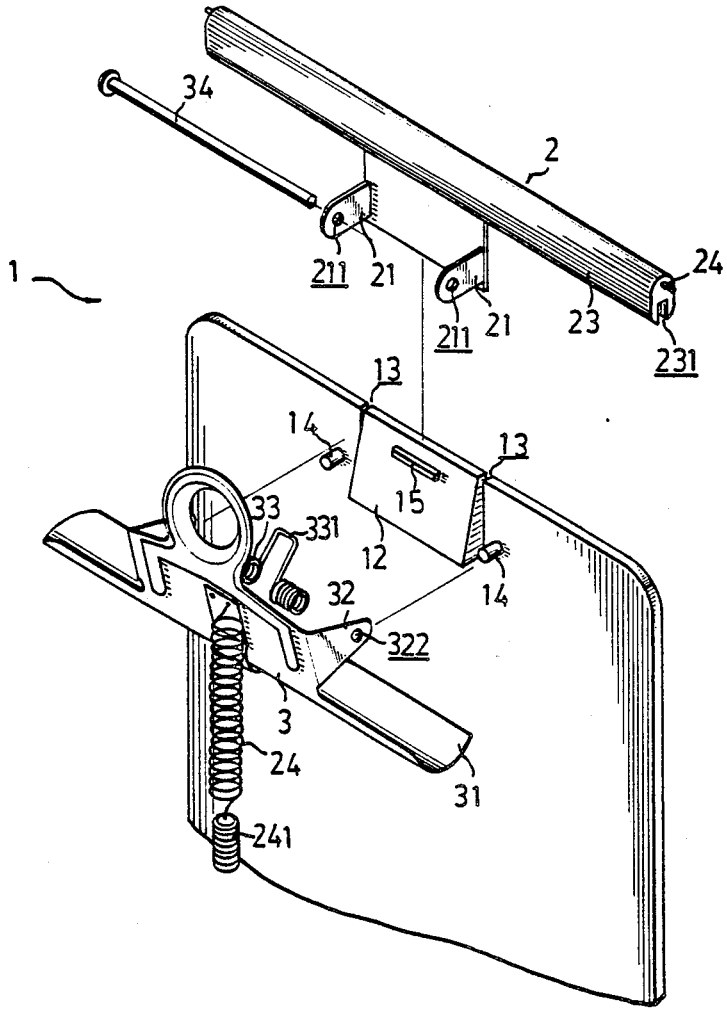
FIG. 2 is a partially exploded view of the clip-board of FIG. 1, illustrating assembly of the clip and the board.
Figure 3:
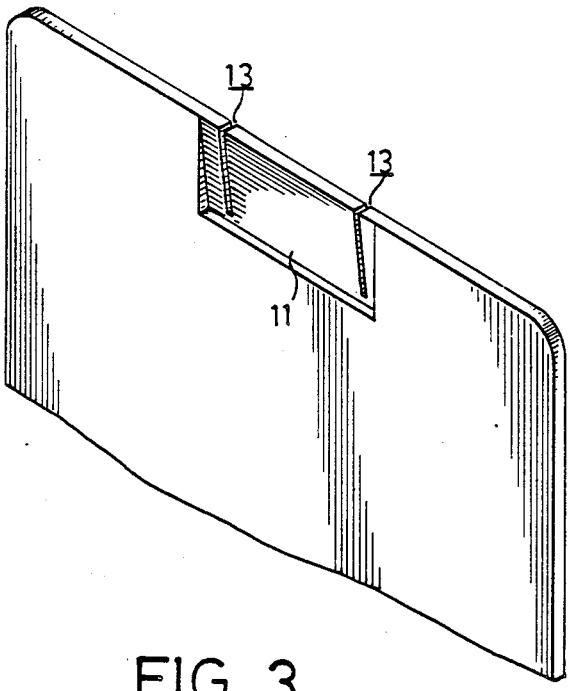
FIG. 3 is a partially cutaway perspective view illustrating a rectangular wedge-like recess formed on the top middle of the clip-board of FIG. 1.
Figure 5:
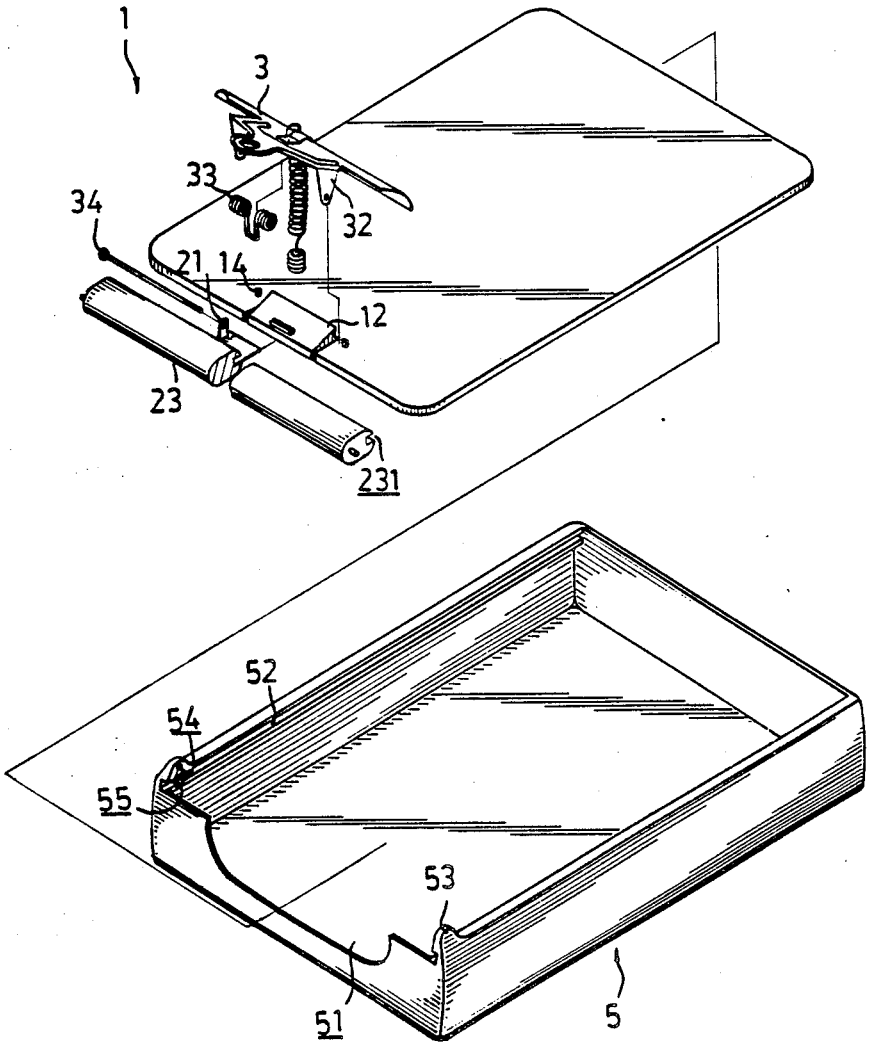
FIG. 5 is an exploded view of the combination clip-board and case of FIG. 1.

As can been seen in FIG. 5, a combination clip-board and case in accordance with the present invention substantially comprises a clip-board 1 and a case 5. Furthermore, the clip-board 1 is a combination of a clip 3 and a board 10. Now with reference to FIG. 2, the clip-board 1 has a base 2 secured thereon for matching with a clip 3. At the center of the top portion of the board 10 there is a rectangular wedge-like recess 11 (as shown in FIG. 3), for the purpose of forming an attachment with a slanted surface 12 which is formed with a protuberance 15 protruding therefrom. A post 14 is formed proximate to each side of the slanted surface 12 for supporting a second lug 32. A vertical slot 13 is formed through the clip-board 1 between the slanted surface 12 and each post 14.

Figure 4:
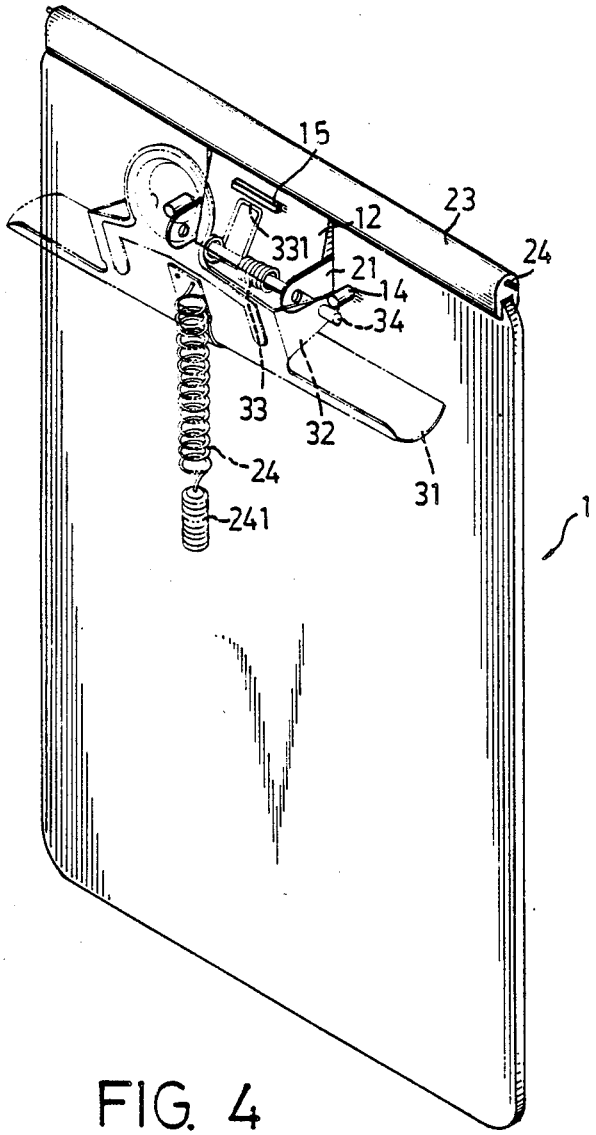
FIG. 4 is a perspective view of the clip-board of FIG. 1, wherein the clip and means for assembling are shown in broken lines in order to illustrate the structure of the clip-board.

The base 2 is integral with a pivoting means 23 which is slightly shorter than the width of the clip-board 1. A pin 24 is integral to each distal end of the pivoting means 23 in such a manner that the pins 24 are aligned with the edges of the board 10 1. A first lug 21 with a first bore 211 thereon is connected to each side of the base 2 so as to fit each vertical slot 13. The pivoting means 23 is substantially cylindrical and formed with an axial slot 231 therein for engagement with the board 10 1 by inserting the top portion of the board 10 1 into the axial slot 231 (as shown in FIG. 4).

The clip 3 has a retainer arm 31 for clamping paper on the clip-board 1 and the second lug 32 which is bent upwardly with a second bore 322 thereon so as to engage with the base 2 by means of a bolt 34 passing through the first bores 211 and the second bores 322 in such a manner so that the clip 3 is securable to and releasable from the base 2. Two torsional springs 33 which are interconnected with each other by an inverse U-shaped means 331 are interposed between the clip 3 and the slanted surface 12, one elongation 332 of each torsional-spring 33 being against the clip 3 and the inverse U-shaped means 331 being against the protuberance 15 so that the torsional-spring 33 is securely workable on the clip-board 1, as shown in FIG. 5. The clip 3 is adapted to clamp the paper due to the torsional-springs 33. Additionally, a spring-like means 35 is provided, with one end being connected to the clip 3, and the other end being connected with a cap 35, for receiving a pen.

Figure 1:
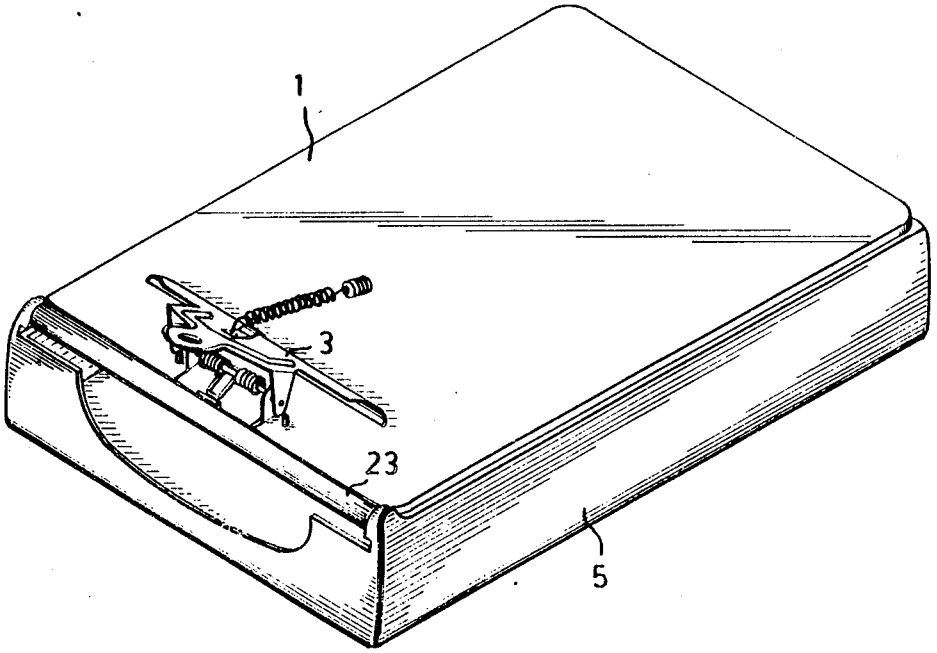
FIG. 1 is a perspective view of a clip-board and case in accordance with the present invention.
Figure 9:
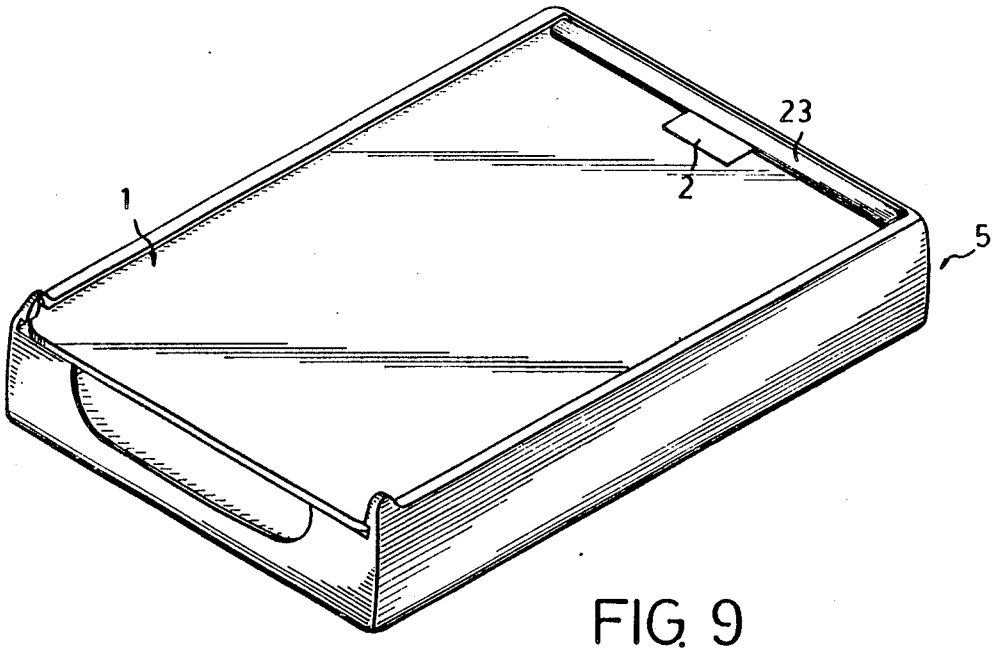
FIG. 9 is a perspective view of the combination clip-board and case of FIG. 1, excluding the clip.
Figure 10:
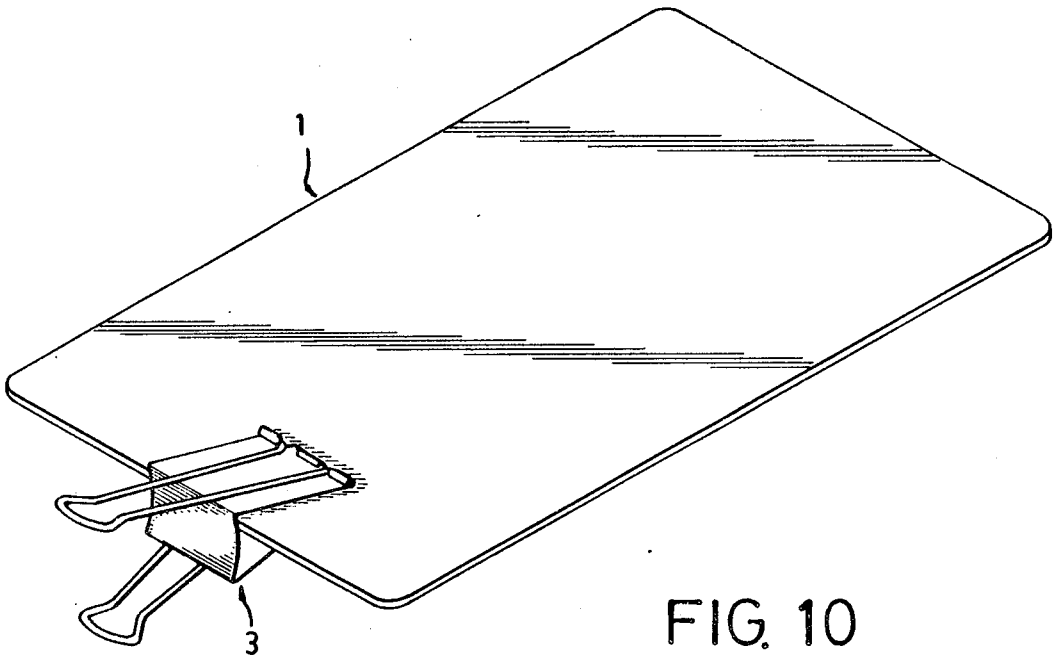
FIG. 10 PRIOR ART
FIG. 10 is a prior art view of a clip-board.

As can be seen in FIG. 5, the case 5 with a cam cutout 51 formed an one side of the case 5 has a sliding groove 52 formed along the whole length of two sides perpendicular to the side where the cam cutout 51 is formed. Further to this, a protrusion 53 is employed on the end of the respective sliding groove 52 adjacent to the cam cutout 51 to formed a hollow portion 54, thereby permitting the pins 24 of the pivoting means 23 to be rotatable therein. A slot 55 is provided directly below each hollow portion 54 for accommodating the pins 24. Referring to FIGS. 1 and 9, the clip-board 1 is fittable on the case 5 and is insertable into the sliding groove 52.

Figure 8:
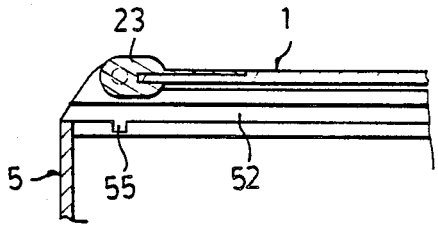
FIGS. 6 to 8 are working views of the combination clip-board and case of FIG. 1, illustrating the clip-board pivoting in the hollow portion of the case, and further showing the combination clip-board and case being optionally in a working or storage state.
Figure 7:
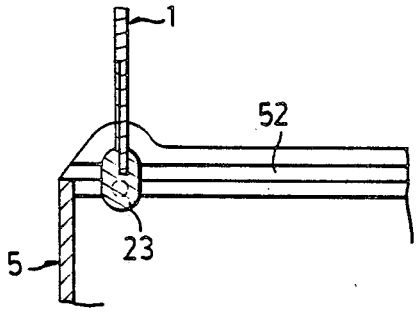
Figure 6:
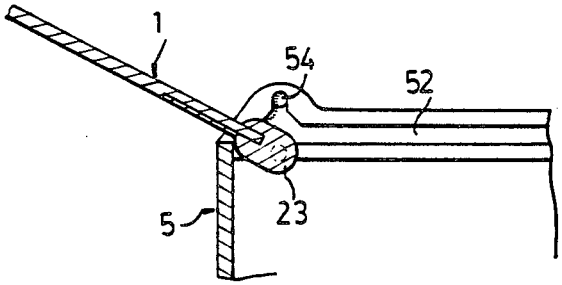

Referring to FIGS. 6, 7 and 8, the transitional states between the working and storage states of the clip-board 1 and the case 5 can be seen. When the combination clip-board and case is in storage state, as shown in FIG. 9, that is to say, when the clip 3 faces inwardly, the pins 24 of the pivoting means 23 fit in the sliding grooves 52 of the case 5, respectively. When the user wants to work the combination clip-board and case, the end opposite to the end where the clip 3 is located should be drawn out until the pins 24 fit in the slots 55 and then rotated clockwise, as seen in FIG. 6. When the clip-board 1 is vertical, then the pins 24 slide down into the hollow portion 54. Then the clip-board 1 is rotated clockwise again so that it completely rests on top of the case 5. Thus the clip-board 1 remains "hinged" at the protrusions 53. To "hide" the clip-board 1, simply reverse the above procedure.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

We claim:

1. A combination clip-board and case, said combination comprising a clip-board (1) and a case (5) wherein:

said clip-board comprising a combination of a board (10) and a clip (3); said board (10) having two vertical slots (13) at a top portion thereof; said clip-board having a pivoting means (23) which has an axial slot (231) for receiving said board (10) through insertion of the top margin thereof into said axial slot (231); a pin (24) being employed at each end of said pivoting means (23) for rotatably hinging said board to said case;

an integral base (2) extending from said pivoting means (23) thereunder; said base having two first lugs (21) each having a respective first bore (211) therethrough, such that said lugs (21) are passable through said vertical slots (13) and attachable to said clip (3);

a clip (3) having two second lugs (32), said second lugs each having a respective second bore (322) therethrough; said first lugs (21) being respectively attachable to said second lugs (32) by means of a bolt (34) passing through said first bores (211) and second bores (322);

said case (5) having a cam cutout (51) formed on a side thereof; said cam output (51) providing an opening in said case through which the clip is passable; a sliding groove (52) being provided along the whole length of the sides which are perpendicular to said side where said cam cutout is formed;

a protrusion (53) being formed on the end of each said sliding groove (52) adjacent to said cam cutout (51); a hollow portion (54) being provided within said protrusion (53) for receiving said pivoting means (23); a slot (55) being defined directly below said hollow portion (54) allowing passage of said pins (14) from said protrusion (53) into said sliding groove (52); and said pins (14) being slidable within said sliding groove (52).

2. A combination clip-board and case as claimed in claim 1, wherein said clip-board is pivotable about said pins in said hollow portion in such a manner that said clip-board is optionally settable to a working or a storage position.

3. A combination clip-board and case as claimed in claim 1, wherein a spring-like means is provided, one end thereof being connected to said clip, and another end thereof being connected with a cap for receiving a pen.

* * * * *